US006722322B2

(12) United States Patent
Tse

(10) Patent No.: US 6,722,322 B2
(45) Date of Patent: Apr. 20, 2004

(54) INTERNAL COMBUSTION ENGINE

(76) Inventor: Kwong Wang Tse, Unit 1609, Block T, Telford Garden, Kowloon Bay, Kowloon (HK)

( * ) Notice: Subject to any disclaimer, the term of this patent is extended or adjusted under 35 U.S.C. 154(b) by 0 days.

(21) Appl. No.: 10/123,402

(22) Filed: Apr. 17, 2002

(65) Prior Publication Data

US 2003/0196614 A1 Oct. 23, 2003

(51) Int. Cl.[7] ..... F02B 59/00
(52) U.S. Cl. ..... 123/46 A; 123/51 R; 123/53.6
(58) Field of Search ..... 123/46 A, 53.3, 123/53.6, 51 R

(56) References Cited

U.S. PATENT DOCUMENTS

| | | | | | |
|---|---|---|---|---|---|
| 1,616,137 | A | * | 2/1927 | Palmer | 123/53.3 |
| 1,719,537 | A | * | 7/1929 | Dulche | 123/53.3 |
| 2,693,076 | A | * | 11/1954 | Francis | 123/46 A |
| 3,010,440 | A | | 11/1961 | Roth | |
| 4,205,528 | A | * | 6/1980 | Grow | 123/46 A |
| 4,284,055 | A | * | 8/1981 | Wakeman | 123/556 |
| 4,407,240 | A | * | 10/1983 | Fromson | 123/55.7 |
| 5,465,702 | A | * | 11/1995 | Ferrenberg | 123/543 |
| 5,540,191 | A | * | 7/1996 | Clarke | 123/541 |
| 5,632,255 | A | * | 5/1997 | Ferrenberg | 123/543 |
| 6,199,519 | B1 | * | 3/2001 | Van Blarigan | 123/46 A |
| 6,199,520 | B1 | * | 3/2001 | Warren | 123/48 R |
| 6,318,309 | B1 | | 11/2001 | Burrahm et al. | |

FOREIGN PATENT DOCUMENTS

| | | |
|---|---|---|
| DE | 19722129 | 12/1998 |
| WO | WO 01/23723 | 4/2001 |

* cited by examiner

*Primary Examiner*—Henry C. Yuen
*Assistant Examiner*—Jason Benton
(74) *Attorney, Agent, or Firm*—Burns, Doane, Swecker & Mathis, L.L.P.

(57) ABSTRACT

An internal combustion engine including at least one engine cylinder, the cylinder includes a cylinder cavity with first and second cylinder heads which are interconnected by a cylinder wall, the cylinder further includes a piston member which is slidably movement within the cylinder cavity and between a first and a second extreme position intermediate between the first and second cylinder heads, the piston member partitions the cavity into a first and a second combustion chambers which are in alternate combustion when in normal engine operation. This engine cylinder configuration substantially increases the usable cylinder volume to enhance efficiency and reduces the weight to power ratio.

16 Claims, 16 Drawing Sheets

FIG. 4a
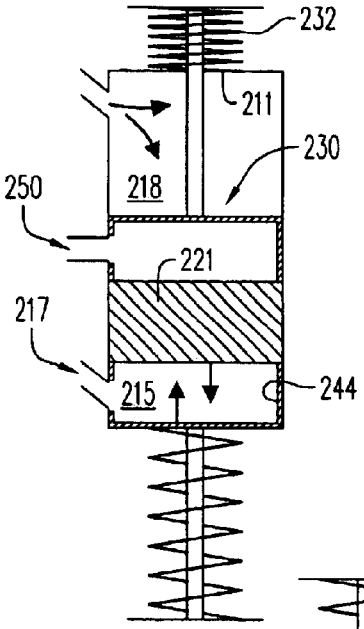
FIG. 4b
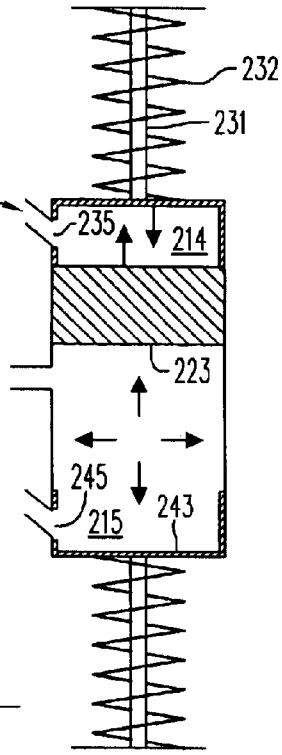
FIG. 4c
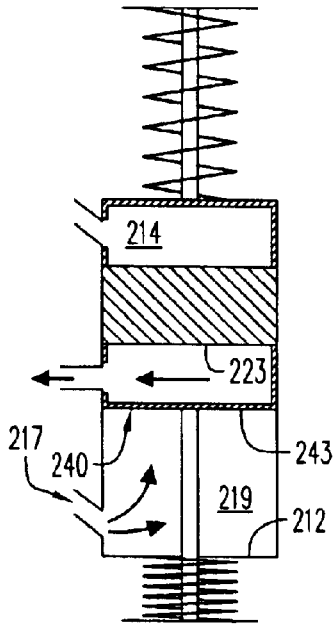
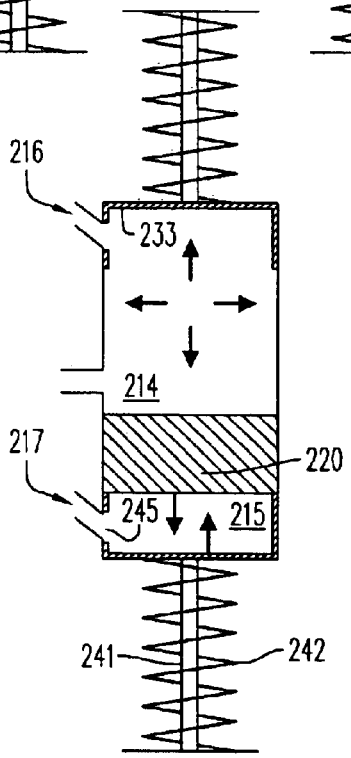
FIG. 4d
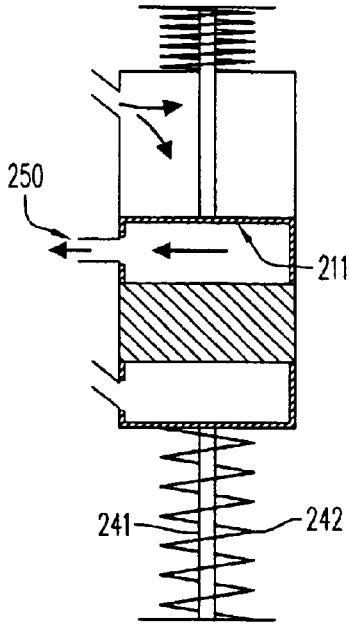
FIG. 4e FIG. 5a
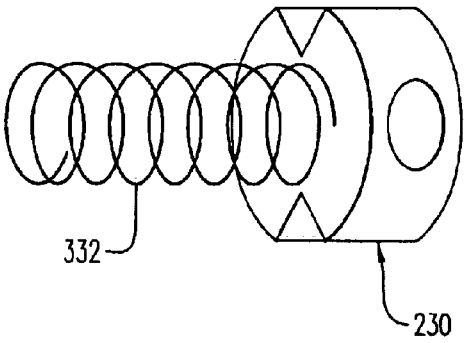
FIG. 5b
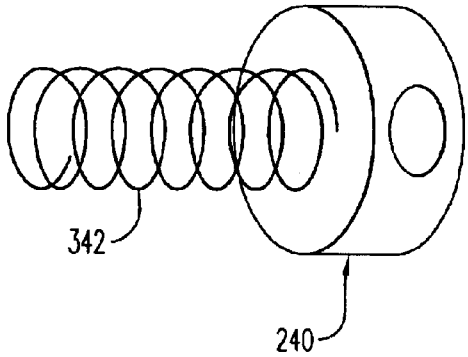
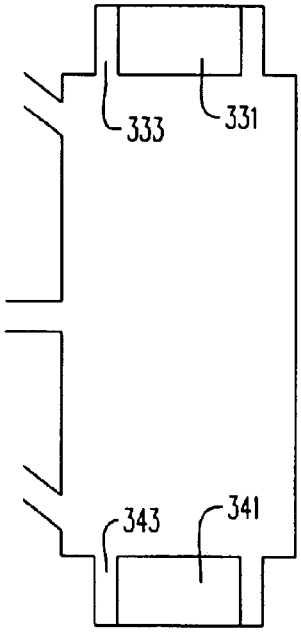
FIG. 5c FIG. 7a
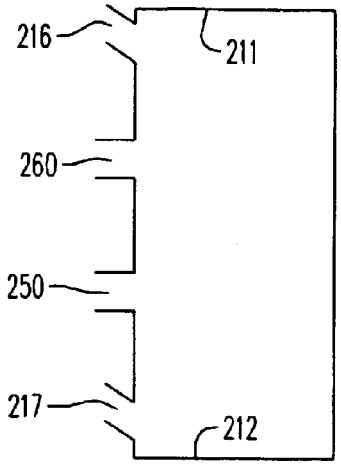
FIG. 7b
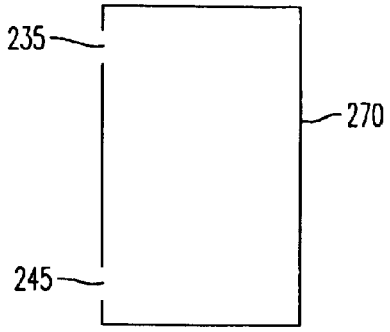
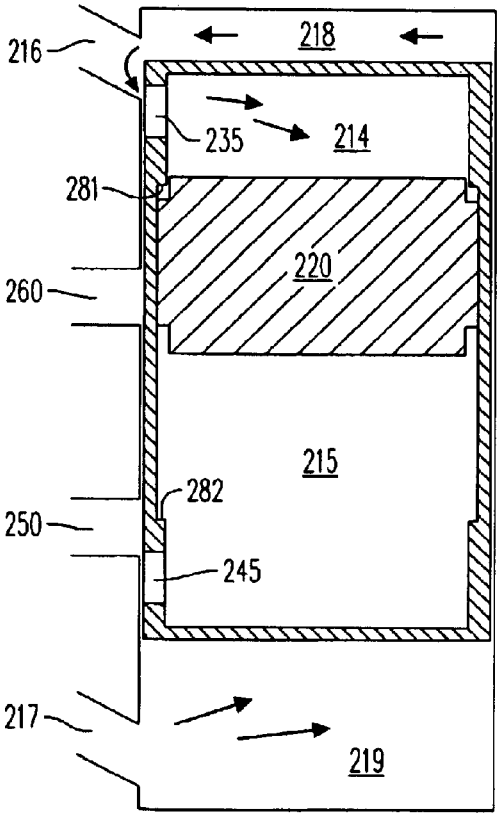
FIG. 7c
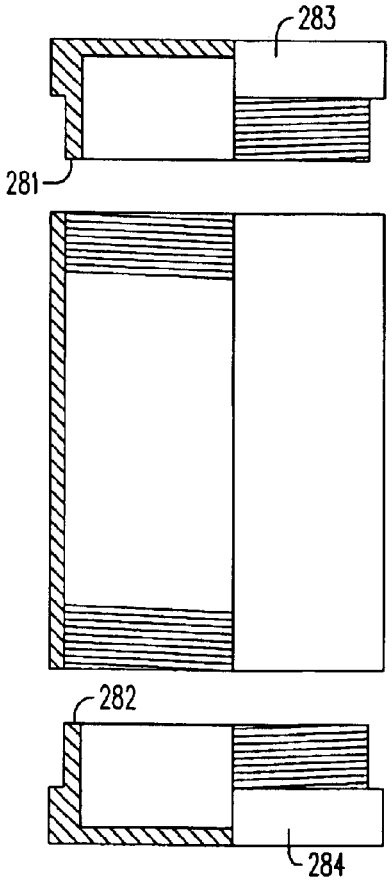
FIG. 7d FIG. 10a
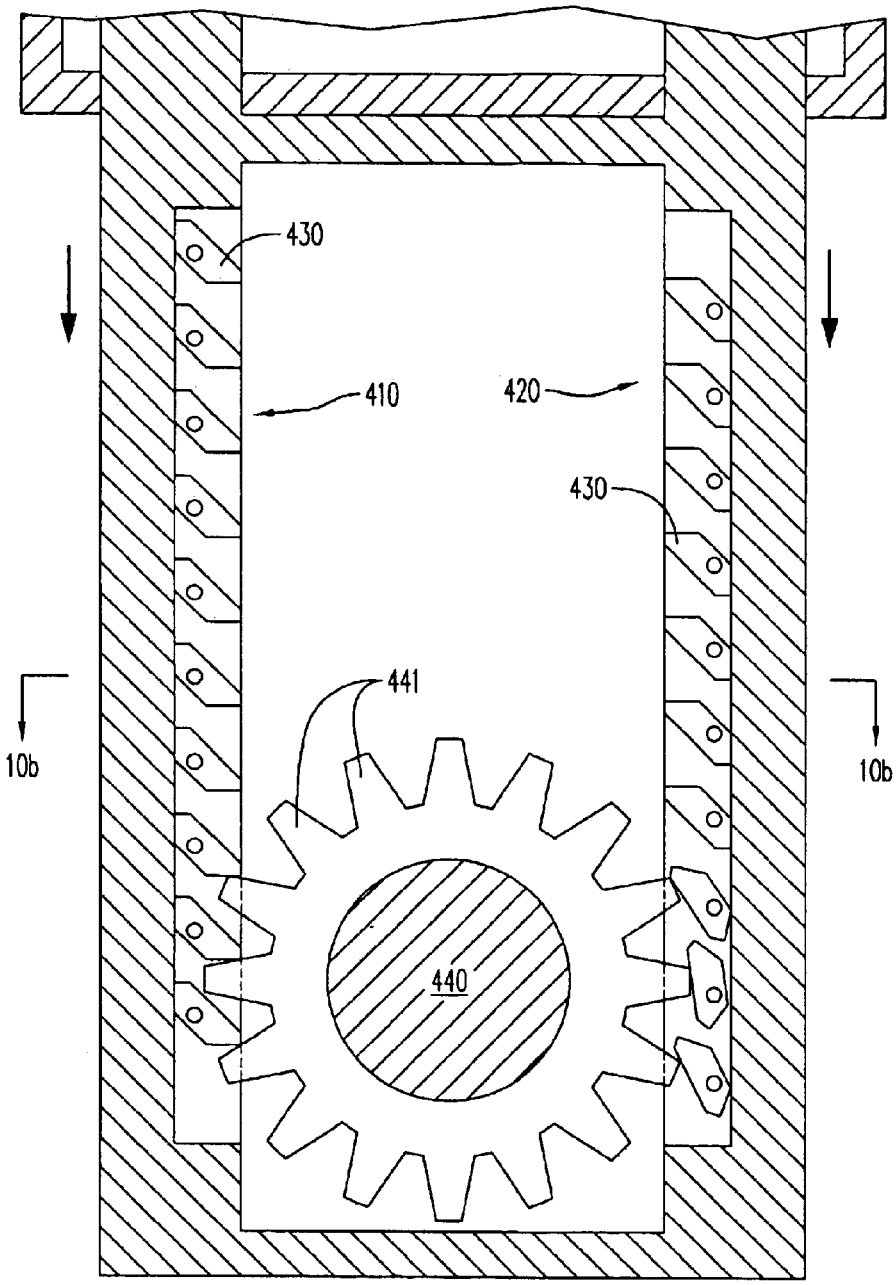
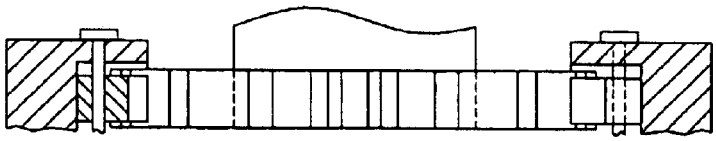
FIG. 10b

INTERNAL COMBUSTION ENGINE

FIELD OF THE INVENTION

This invention relates to internal combustion engines and, more particularly, to internal combustion engines in which a common cylinder and a common piston are shared between a pair of alternate combustion chambers. More specifically, this invention relates to an internal combustion engine of the four-stroke type with a reciprocating piston member which partitions a common cylinder to form two combustion chambers.

BACKGROUND OF THE INVENTION

Internal combustion engines are widely used as power plants for many equipment and apparatuses such as automobiles, power generators, pumps, compressors, ships, tractors, machines, and aeroplanes. In order to supply adequate power, conventional internal combustion engines are generally formed by connecting a plurality of alternately combusting cylinders together. Bach cylinder of an internal combustion engine generally includes a hollow combustion chamber inside which there is disposed a linearly and reciprocally moveable piston member.

In general, the piston is driven towards the cylinder head, which is usually the ceiling of a cylinder, to compress the gaseous fuel mixture introduced into the cylinder during one part of the engine cycle. The subsequent timely combustion of the compressed fuel causes an explosion to drive the piston away from the cylinder head. This movement also drives the connecting power transmission mechanism to deliver the resulting mechanical power outside of the cylinder for the intended use.

In general, 1) fuel intake, 2) compression, 3) combustion and 4) exhaustion are the typical steps involved in a complete engine operation cycle of a conventional four-stroke internal combustion engine. Because an engine cylinder must withstand the enormous explosive force during the engine operating cycles, internal combustion engines are typically made of steel, wrought iron or other ferrous or non-ferrous metal alloys which are inherently heavy and bulky. Since a plurality of engine cylinders are usually connected together to provide sufficient power output as well as for smooth engine operation, the weight of engines becomes an important factor to negotiate if to improve the efficiency of an engine is to be improved. In general, engine designers endeavour to minimize the engine weight-to-power output ratio, or, alternatively, to maximise the power-to-weight ratio per combustion cylinder. Also, in a multi-cylinder engine, usually only one cylinder delivers power at a time which means that the instantaneous power generating engine must also drive the remaining non-power generating pistons and the connecting mechanism. Therefore, it will be beneficial if the connecting mechanism or parts between cylinders can be minimized for a given set of cylinders.

For example, U.S. Pat. No. 6,318,309 describes an internal combustion engine in which two pistons are reciprocatively disposed in each cylinder thereby forming combustion chambers at each end of the cylinder plus a third combustion chamber between the pistons. However, two sets of rather complicated piston connecting rods are required and a third piston is responsible for a specific combustion chamber area not served by the other pistons. U.S. Pat. No. 3,010,440 teaches another example of an internal combustion engine having more than one piston disposed in a single cylinder in which each piston covers its own combustion chamber which is not served by the other piston.

In a conventional four-stroke cycle internal combustion engine, the complete engine operating cycle of fuel intake, compression, combustion and exhaust requires two cycles of linearly reciprocal motion of the piston member. In other words, the piston member has to move up and down twice in order to complete a single engine cycle. Since the engine cycle involving fuel combustion is the only power generating cycle, the other piston cycle is non-power generating but power consuming, noting that the piston is usually always connected to an external load. Hence, it will be highly beneficial if there can be provided an improved internal combustion engine or engine topology which can overcome or at least mitigate the short-comings associated with the afore-said disadvantages of conventional internal combustion engine.

OBJECT OF THE INVENTION

Hence, it is an object of the present invention to provide an improved internal combustion engine or engine topology which overcome or, at least, mitigate disadvantages associated with conventional internal combustion engines. More specifically, it is an object of the present invention to provide an improved internal combustion engine or engine topology which serves to improve engine performance by reducing the engine weight-to-power output ratio. It is also an object of the present invention to provide an internal combustion engine or engine topology in which the piston only needs to go through a single set of leniently reciprocal motion in order to complete the fuel intake, compression, explosion and exhaust cycles of an engine operation. As a minimum, it is at least an object of the present invention to provide the public with a choice of a novel internal combustion engine or engine topology to be described hereinafter.

SUMMARY OF THE INVENTION

In view of the afore-said objectives and according to the present invention, there is provided an internal combustion engine including at least one engine cylinder, said cylinder includes a cylinder cavity with first and second cylinder heads which are interconnected by a cylinder wall, said cylinder includes a piston member which is slidably movement within said cavity and between a first and a second extreme position intermediate between said first and second cylinder heads, said piston member partitions said cavity into a first and a second combustion chambers which are in alternate combustion when in normal engine operation.

Preferably, said engine further including a slidable diaphram member in each said combustion chamber, said diaphram member includes a spacer separating a cylinder head and the corresponding piston surface of a combustion chamber, whereby defining the minimum volume of said combustion chamber.

Preferably, said engine further including a slidable member disposed in each said combustion chambers and partitioning said combustion chamber in to a first compartment with one end being a cylinder head and a second compartment with one end being said piston, said first and second compartments are generally not mutually communicable except at a specific position of said diaphram member at which position combustible gas in said first compartment will be transferred to said second compartment during normal engine operations.

Preferably, during normal engine operations, combustion occurs in said second compartment of one combustion chamber, that is, in the enclosed space between said diaphram and said piston, such that, during combustion, said piston are driven away from said diaphram and pushed towards the other chamber to compress said other chamber.

Preferably, said engine further including means to drive said diaphram towards said piston to remove exhaust from said cylinder subsequent to each combustion involving the chamber comprising said diaphram.

Preferably, combustible gaseous fuel is introduced into said first compartment of said combustion chamber at the time when exhaust is being removed from said second compartment of said chamber.

Preferably, combustible fuel is introduced into said first compartment through a valve aperture, said aperture when aligned with a specific part on said diaphram forms a communication path between said first and second compartments, thereby allowing compressed gaseous fuel to be transferred from said first compartment into the adjacent second compartment.

Preferably, combustion in one combustion chamber forces said piston and the diaphram member of another chamber to move towards the cylinder head of that another chamber to compress the gaseous fuel in said first compartment of that other chamber during normal engine operation.

Preferably, said cylinder is characterised in that when a combustion chamber is maximally compressed, the other combustion chamber is fully relaxed and vice versa.

Preferably, said diaphram member includes a base and a wall surrounding said base, said wall being axially extending away from said base and said cylinder head adjacent said base such that the axial extension of said wall defines the minimum axial clearance of said combustion chamber comprising said diaphram.

Preferably, an aperture is formed on said surrounding wall, such that said aperture provides a communication path between the two sides of said diaphram within said chamber when said diaphram is moved to a specific, pre-determined position.

Preferably, said pre-determined location corresponds to the position when said volume of said chamber is at a minimum.

Preferably, said piston member includes a bifurcated pair of legs protruding out of said cylinder, said bifurcated legs being connected with a rotary member which converts the translational movements of said bifurcated legs into rotary movements of said rotary member.

Preferably, each said bifurcated legs includes ratchet teeth which are engageable with teeth on said rotary member, said teeth on said bifurcated legs being arranged so that said teeth on said bifurcated legs are in driving engagement with the teeth on said rotary wheel when said bifurcated legs move in a first direction and said teeth on said bifurcated legs and said rotary member are not in driving engagement when moving in a direction opposite to said first direction, said direction of movements of said bifurcated legs for driving engagement with the teeth on said rotary member being opposite for teeth disposal on the two legs forming the bifurcated legs.

According to a second aspect of the present invention, there is provided an internal combustion engine including at least an engine cylinder, said engine cylinder includes a hollow cylinder room enclosed by a cylinder wall and a first and a second cylinder heads at the ends of said cylinder room, said engine cylinder further includes a piston having a first and a second piston surfaces, said piston is disposed within said cylinder room and partitions said cylinder room into a first and a second combustion chambers, wherein said first combustion chamber is formed by co-operation of said first piston surface and said first cylinder head and said second combustion chamber is formed by co-operation of said second piston surface and said second cylinder head, said piston being movable between a first and a second piston positions between said cylinder heads, said first and second piston positions correspond respective to said first and second combustion chambers of their minimum chamber volumes, such that, during engine operations, a complete cycle of reciprocating movements of said piston from one starting position back to that starting position corresponds to a complete engine combustion cycle in both said first and second combustion chambers.

BRIEF DESCRIPTION OF THE DRAWINGS

Preferred embodiments of the present invention of an internal combustion engine or engine topology will be explained in more detail in the specific description below by way of examples and with reference to the accompanying drawings in which:

FIGS. 4*a* to 4*e* illustrate a series of engine operation of the engine of FIGS. 2 and 3 corresponding to a conventional four-stroke cycle including the steps of compression, combustion, exhaustion, and fuel intake;

FIGS. 5*a* to 5*b* illustrate respectively the first and second diaphram valves of FIG. 3 with a spring attachment showing a second embodiment of diaphram valves for the present invention;

FIG. 5*c* illustrates a second preferred embodiment of a cylinder housing for the present invention;

FIGS. 7*a* to 7*b* illustrate respectively the cylinder housing and an internal cage of a third embodiment of the present invention;

FIG. 7*c* shows a cylinder of the third embodiment of the present invention including the parts shown in FIGS. 7*a* and 7*b;*

FIG. 7*d* shows an example structure of the internal cage housing of FIG. 7*b;*

FIG. 10 is an enlarged view showing the enlarged relationship between the piston connecting rod and the power transmission;

DETAILED DESCRIPTION OF THE PREFERRED EMBODIMENTS

Figure 1A:
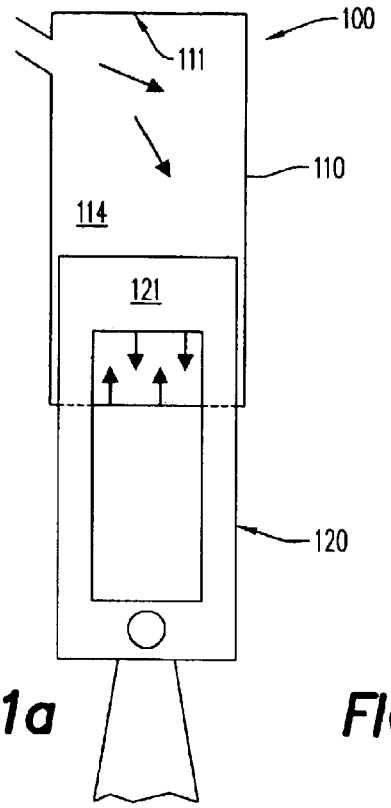
FIGS. 1*a* to 1*b* show schematic diagrams of an internal combustion engine illustrating the principle of operation of a first preferred embodiment of the present invention.

Referring firstly to FIGS. 1*a* to 1*d*, there are shown simplified sketches of a first preferred embodiment of the present invention of a cylinder of an internal combustion engine. The figures show a series of engine operating movements to illustrate the general principles of operation of the present invention. The engine generally includes at least one engine cylinder, although a plurality of engine cylinders may be, and are generally, connected together to meet with specific power and operation requirements and to fulfil various performance criteria.

The cylinder (100) generally includes a hollow cylinder housing (110) having a first cylinder head (111) and a second cylinder head (112) which are interconnected by a cylinder wall. The cylinder (100), including the cylinder housing (110), the piston member (120) and some of the related connecting parts, is preferably made of steel, wrought iron or other rigid metal, both ferrous and non-ferrous, alloys suitable for engine making. The space or cavity defined between the cylinder heads and the surrounding cylinder wall forms a pair of combustion chambers for power generation to be explained in more detail below. The piston member includes a piston head (121) which is slidably moveable along the length of the hollow cylinder and between the two cylinder heads (111, 112). The piston head (121) is disposed within the cylinder so that it partitions the cylinder cavity into a first (114) and a second (115) combustion chambers which are not communicable with each other.

The first combustion chamber (114) is formed by the piston head (121) co-operating with the first cylinder head (111) while the second combustion chamber (115) is formed by the piston head (121) co-operating with the second cylinder head (112). More specifically, the piston head (121) includes a first (122) and a second (123) piston surfaces which are back-to-back disposed so that the first piston surface (122) co-operates with the first cylinder head (111) to form the first combustion chamber (114) and the second piston surface (123) co-operates with the second cylinder head (112) to define the second combustion chamber (115).

In general, the piston head (121) is moveable between a first extreme position and a second extreme position intermediate between the cylinder heads corresponding respectively to the most compressed states of the first (114) and the second (115) combustion chambers. It will be noted that the chamber volume of the first and the second combustion chambers is oppositely incremental. That is, when the first combustion chamber (114) increases in volume, the second combustion chamber (115) decreases in volume and vice versa. In other words, the volume of the first and the second combustion chambers is generally complementary which together constitutes the instantaneous effective cylinder volume.

The piston member (120) is connected to a connecting rod (124) so that the power generating movements of the piston member resulting from the combustion of fuel in the combustion chambers can be transmitted out of the cylinder (100). On the other hand, the piston member (120) may be driven to compress the gaseous fuel mixture in a combustion chamber in advance of and to prepare for combustion.

Referring to FIG. 1*a*, the cylinder (100) is shown with the second combustion chamber (115) in the most compressed state so that the first combustion chamber (114) is at its most relaxed (or least compressed) state. At this time, gaseous fuel mixture is introduced into the first combustion chamber (114) while the compressed gaseous fuel in the second combustion chamber (115) is ready to be ignited.

Figure 1B:
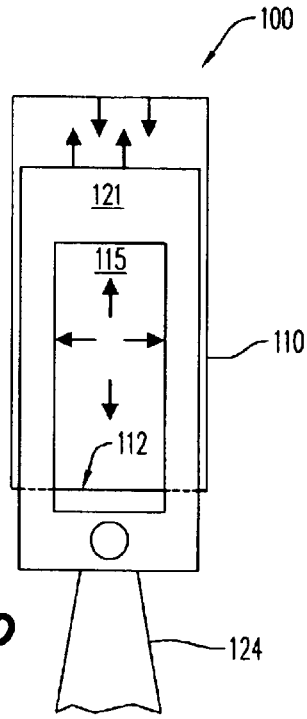

Upon ignition, combustion of the gaseous mixture causes explosion within the second combustion chamber (115) and drives the piston head (121) towards the first cylinder head (111) to incrementally compress the first combustion chamber (114) towards the most compressed state as indicated in FIG. 1*b*. At this instant, the gaseous fuel mixture in the first combustion chamber (114) is ready to be ignited.

Figure 1C:
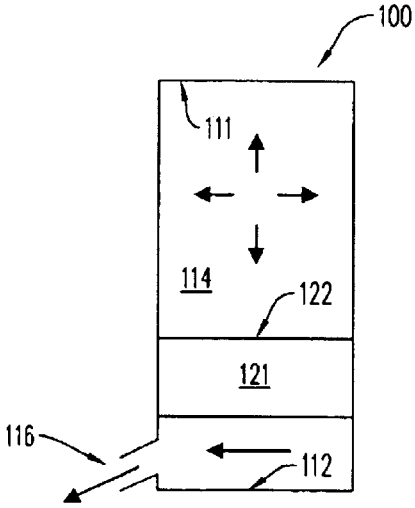
FIGS. 1*c* and 1*d* are simplified cross-sectional views generally orthogonal to that of FIGS. 1*a* and 1*b;*

Upon ignition of the gaseous fuel in the first combustion chamber (114), the explosion in the first combustion chamber (114) will drive the piston head (121) towards the second cylinder head (112). This consequential piston movement also expels the exhaustible gaseous waste from the second combustion chamber (115) through the exhaust outlet (116) as illustrated in FIG. 1*c*.

Upon disposal of the by-products of combustion of the second combustion chamber (115), the piston will be moved back towards the first cylinder head (111) to expel the by-products of combustion of first combustion chamber through the outlet (117). At this instant, fresh fuel mixture will be introduced into the second combustion chamber as shown by the arrows in FIG. 1*d*.

Figure 1D:
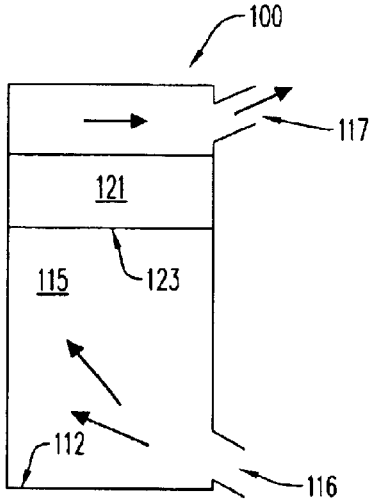

Upon completion of the disposal of the after-burnt from the first combustion chamber (114) as indicated by the step shown in FIG. 1*d*, the piston member will again be driven towards the second cylinder head (112) as shown in FIG. 1*a* to prepare for the next combustion in the second combustion chamber and the steps illustrated in the above series of figures will repeat.

It will be noted from the above description that the four-stroke movements described above correspond to a complete engine combustion cycle of both the first and the second combustion chambers. Hence, it can be expected that the power generated by a complete cycle of the present cylinder will be equivalent or comparable to the power generated by two cylinders in a conventional engine arrangement. However, since a single piston member is shared between the two combustion chambers within a single cylinder cavity, connecting rods as required in conventional engine arrangements between the two co-operating alternate combustion chambers are no longer necessary, thereby reducing the power expended in driving the interconnection. Furthermore, it will be noted that the cylinder cavity which is above as well as below the piston head (121) is utilized so that the effective engine volume is significantly increased compared to an engine cylinder of the conventional type in which only the space above the piston head is utilised. Consequently, the weight of the cylinder per unit effective cylinder volume will be substantially reduced.

Figure 2:
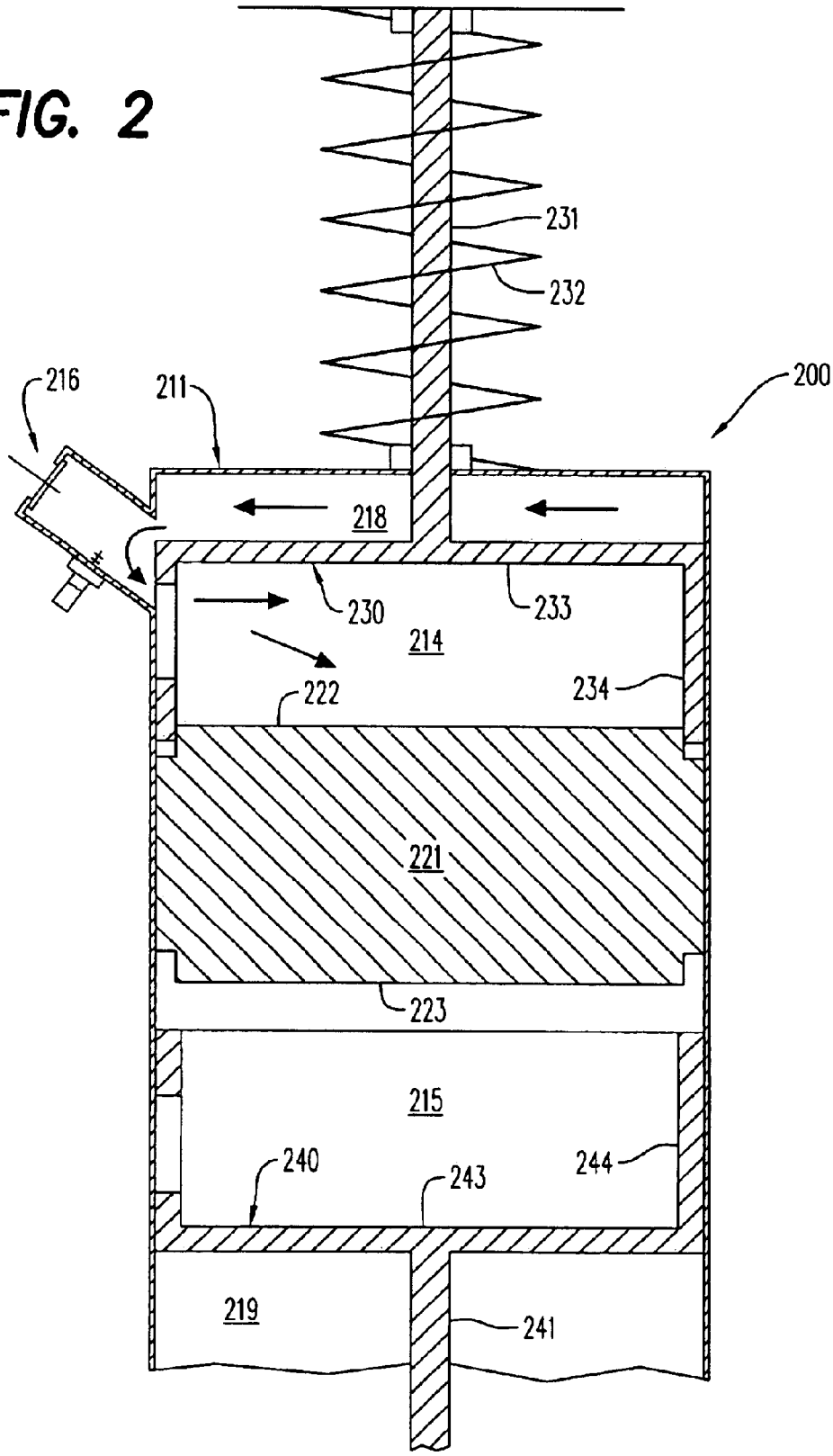
FIG. 2 is a schematic diagram illustrating a more detailed construction of an engine of FIG. 1 and for illustrating one of the engine cycles.

Referring to FIGS. 2 and 4 in which the same numerals are used throughout to refer to the same parts, there is shown an example construction of a preferred embodiment of the cylinder (200) of the present invention. The cylinder (200)

includes a piston member (220) having a piston head (221), a first diaphram valve (230) and a second diaphram valve (240). The first diaphram valve (230) is disposed intermediate between the piston head (221) and the first cylinder head (211). The second diaphram valve (240) is disposed between the piston head (221) and the second cylinder head (212). The first diaphram valve (230) is associated with a first diaphram stem (231) and a first diaphram spring (232) member which protrude outside the cylinder. The first diaphram spring (232) shown in this instant is stretched from its spring-neutral configuration, so that the first diaphram valve (230) will spring back towards the other diaphram valve (240) once the restraining force has been removed. The second diaphram valve (240) is associated with a second diaphram stem (241) and a second diaphram spring (242) member which protrude outside the cylinder.

The piston head (221) includes a first piston surface (222), a second piston surface (223) and is connected to a pair of bifurcated legs (224, 225). The first piston surface (222) co-operates with the first cylinder head (211) to form the first combustion chamber (214) while the second piston surface (223) co-operates with the second cylinder head (212) to form the second combustion chamber (215). More specifically, a first fuel compartment (218) is formed between the first diaphram valve (230) and the first cylinder head (211). A second fuel compartment(219) is formed between the second diaphram valve (240) and the second cylinder head (212).

The piston member (220) includes a pair of downwardly extending bifurcated legs which penetrate through the second cylinder head (212) for external connection as well as for power transmission. The second cylinder head (212) is provided with corresponding shaped apertures and appropriate sealing to ensure proper compression. Of course, the bifurcated legs can protrude from the other cylinder head without loss of generality.

The diaphram valves generally include a cup-shaped member having a transversal non-permeable plate member (233, 243) separating the combustion chamber into two regions and a spacer member (234, 244) for maintaining a minimum distance between the cylinder head and the corresponding opposite piston surface. The spacers generally include an upwardly extending peripheral wall (234, 244) extending from the transversal plate member towards the piston head (221) with its distal end forming a foot-print spreading over the cross-section of the entire cylinder cavity. The other side of the transversal member is provided with a connecting pin (231, 241) which extends axially away from the piston member. The connecting pin (231, 241) protrudes from the adjacent cylinder head and is connected to a spring member (232, 242) for reasons to be explained below.

An aperture (235, 245) is also formed on the peripheral wall of the diaphram valve to direct the flow of gas within the combustion chamber from one region to another. The second diaphram member (240) is further provided with an indentation pair to correspond with the shape of the bifurcated legs of the piston member (220) to allow co-operative movements of the legs in and out of the cylinder. In addition, on each of the first and second piston surfaces of the piston member is provided with an annular ring member to co-operate with the peripheral wall of the diaphram valve which is also annular. The annular indentation on the piston member, when co-operating with the peripheral wall, provides a cushioning or buffering region to mitigate the repetitive impact between the piston member and the diaphram valve by providing a region of compressed air cushioning along the circumference of the piston members. This arrangement helps to reduce the wear-and-tear between the two moving parts. Of course, the shape of the contact parts can be reversed without loss of generality.

In another perspective, it will be appreciated that each diaphram valve partitions the combustion chamber into two rooms, namely, a fuel compartment for fuel intake and compression, and a combustion chamber to facilitate compression, explosion and exhaustion. Due to the arrangements of two oppositely disposed combustions within a single cylinder housing, the piston member (220) can go through a series of four-stroke engine cycle operations by co-operation between the complementary combustion chambers without external assistance during normal operation.

Figure 3:
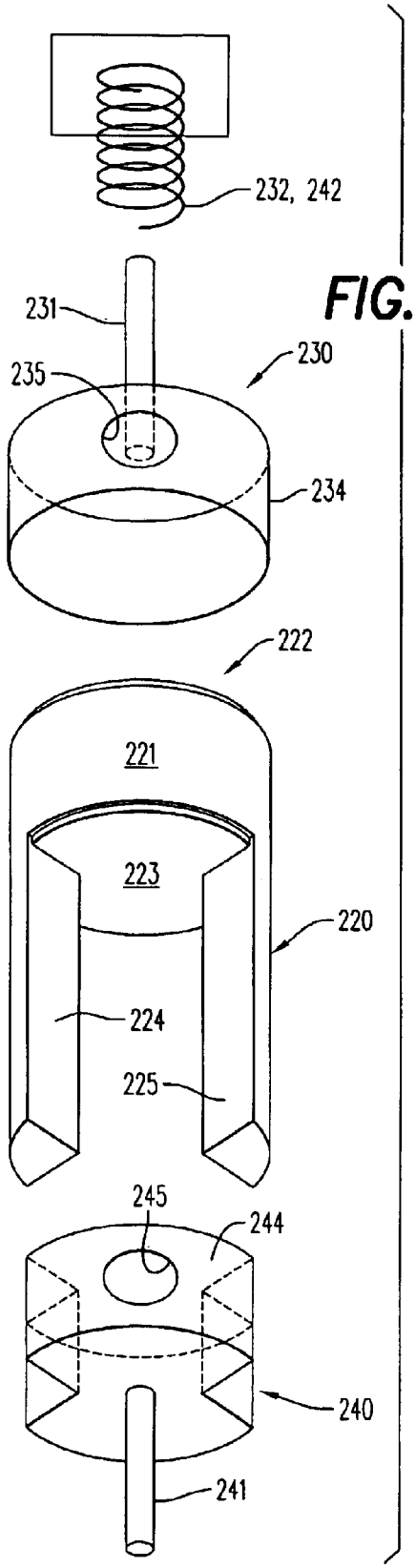
FIG. 3 is a dis-assembled drawing showing the major components of the preferred embodiment of FIG. 2.

The operation of the cylinder with the construction as shown in FIGS. 2 and 3 will be explained below with reference to FIGS. 4*a* to 4*e*.

Referring firstly to FIG. 4*a*, the piston member (220) is driven into a position corresponding to the most compressed state of the second combustion chamber (215) with the transversal member (243) of the second diaphram valve (240) resting against the second cylinder head (212) and the second piston surface (223) touching, or almost touching, the upstanding end of the second diaphram valve peripheral wall (244).

At this instant, the first diaphram valve (230) is furtherest into the first combustion chamber (214) with the side aperture (235) aligned with the exhaust aperture (250) on the cylinder housing, thereby providing an exhaust path for combustion waste of the first combustion chamber (214). At this juncture, the gaseous fuel mixture in the second combustion chamber (215) is maximally compressed and fuel is being introduced into the first fuel compartment (218) which is the space between the base of the diaphram valve (230) and the first cylinder head (211). It will also be noted that the first diaphram valve spring member (232) is at its spring-neutral or substantially un-biased state with the aperture (235) on the first diaphram valve peripheral wall aligned with the exhaust outlet aperture (250) formed on the cylinder housing. On the other hand, the second diaphram valve spring member (242) is at its most stretched spring state and will spring back towards the spring-neutral or substantially un-biased state once the restraining force has been removed.

It will be noted that, prior to this piston movement, gaseous fuel mixture has been introduced into the second fuel compartment (219) defined between the second cylinder head (212) and the second transversal member (243). Continued compression of the second fuel compartment (219) by the forced advance movement of the second diaphram valve (243) by the piston member causes the compressed gaseous fuel to escape into the second combustion chamber (215) defined between the piston (220) and the second diaphram valve (243).

Referring to FIG. 4*b* in which the fuel mixture in the second combustion chamber (215) has just been ignited and the resulting combustion causes explosion to drive the piston member (220) towards the first cylinder head (211). As the explosion occurs in the space between the second diaphram valve (240) and the second piston surface (223), the transversal member (243) of the second diaphram valve remains intact to the second cylinder head (212) with the piston (220) moved furtherest away from the second cylinder head (212) and therefore closest to the first cylinder head (211). At this instant, the gaseous fuel mixture in the first combustion chamber (214) is at its most compressed state.

Similarly to the step described above, when the first diaphram member (230) moves towards the first cylinder head (211), the compressed gaseous fuel mixture already present in the first fuel compartment (218) will be transferred into the first combustion chamber (214), which is the space between the transversal member (233) of the first diaphram valve and the piston head (221), through the fuel by-pass path which is a channel formed by the alignment of the aperture (235) on the peripheral wall and the fuel inlet aperture (216) on the cylinder housing.

Referring now to FIG. 4*c*, the second diaphram valve (240) is now driven towards the piston member (220) to expel the after-burnt while fresh gaseous fuel mixture is being introduced into the second fuel compartment (219) (defined by the space between the transversal member and the second cylinder head). This movement of the second diaphram valve (240) occurs after the effect of explosion force in the second combustion chamber (245) has diminished so that the stretched spring (242) can return to the spring-neutral or substantially un-biased state. When the second diaphram valve (240) extends furtherest into the cylinder cavity, the second diaphram valve connecting pin (241) is generally under minimal or no spring bias, since the associated spring (242) is in its relaxed or spring-neutral state.

Referring now to FIG. 4*d*, the gaseous fuel mixture in the first combustion chamber (214) which is in the most compressed state is ignited. The resulting combustion causes explosion within the first combustion chamber (214) and drives the piston member (220) and the second diaphram valve (240) towards the second cylinder head (212) while the transversal member (233) of the first diaphram member is still intact with the first cylinder head (211). Before the second diaphram member (240) reaches the second cylinder head (212), the gaseous fuel mixture already present in the second fuel compartment (219), that is, the space between the transversal member of the second diaphram member and the second cylinder head, would have been transferred through the fuel by-pass path, which is the channel formed by the alignment of the aperture (245) on the peripheral wall and the second inlet aperture (217) on the cylinder housing, into the second combustion chamber (217), which is the space between the transversal member and the second piston surface. At this instant, the gaseous fuel mixture in the second combustion chamber (215) is at the most-compressed state while the connecting pins of both diaphram members are fully released in which the energy stored in the spring members (232, 242) is maximal.

Referring to FIG. 4*e*, the first diaphram valve (230) is now driven towards the second cylinder head (212) to expel the after-burnt from the cylinder through the common exhaust outlet aperture formed on the cylinder housing. It will be noted that this movement is primarily facilitated by the first diaphram spring member (232) being restored from the most stretched state to its spring-neutral state.

FIGS. 4*a* to 4*e* therefore correspond to a complete four-stroke cycle of each of the two combustion chambers. Furthermore, it will be appreciated that a four-stroke engine cycle is completed with the piston going through only a single reciprocal cycle of movements within the cylinder housing.

In the following description, the same numerals used in FIGS. 2 to 4 will be used where appropriate. The diaphram members and the cylinder housing as shown in FIGS. 5*a* to 5*c* illustrate a preferred example of a cylinder in which the connecting pin is no longer attached to the diaphram valve. Instead, a helical spring (332, 342) is attached directly to the side of the transversal member of the diaphram valve on the other side of the peripheral wall. Furthermore, it should be noted that the spring-biasing conditions of the diaphram valves associated with each engine movement are different from that in FIGS. 2 to 4.

Also, a corresponding annular groove (333, 343) with a central post (331, 341) are formed on the cylinder head and extends axially along the direction of motion of the piston or diaphram valve apart from the annual groove and the central post, the remaining of the cylinder housing is generally identical to that of FIG. 4.

Figure 6A:
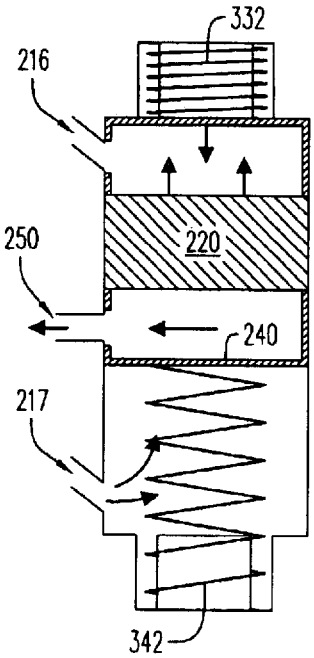
FIGS. 6*a* to 6*c* show a series of engine operating steps illustrating the operation of the second embodiment of the present invention constructed from the components of FIGS. 5*a* to 5*c;*
Figure 6B:
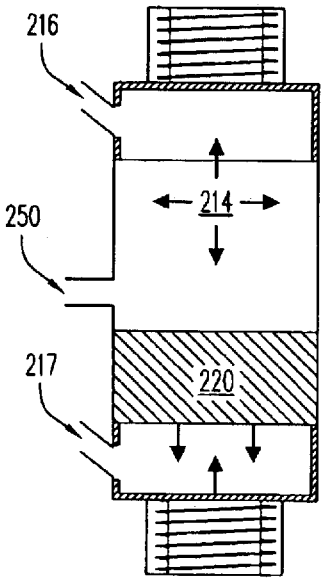
Figure 6C:
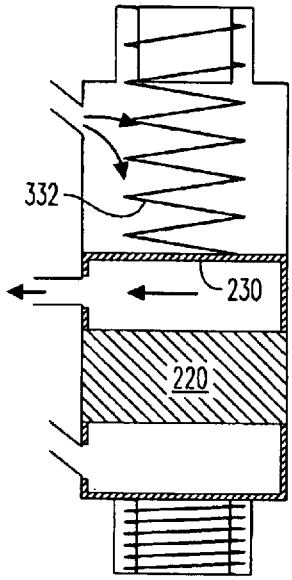

FIGS. 6*a* to 6*c* graphically illustrate the operation of the cylinder constructed with the components shown in FIGS. 5*a* to 5*c* and the series of operations are explained below.

Referring to FIG. 6*a*, the cylinder is at the same state as that shown in FIG. 4*c*. However it will be noticed that the spring (332) associated with the first diaphram member (230) is fully biased in its most-compressed state while that associated with the second diaphram valve (240) is fully relaxed or least compressed state.

Referring to FIG. 6*b*, the cylinder state corresponds to that shown in FIG. 4*d*, although both spring members (332, 342) are fully compressed or biased.

Referring to FIG. 6*c*, in which the cylinder state corresponds to that shown in FIG. 4*e*, although the second spring member (342) is fully biased or urged while the first spring member (332) is fully relaxed.

Apart from the spring biasing conditions and the elimination of the connecting pins, the general operation of the cylinder is identical or equivalent to that described with reference to FIGS. 4*a* to 4*e*.

Referring to FIGS. 7*a* to 7*d*, the cylinder housing now includes a cylinder housing having a first cylinder head (211) and a second cylinder head (212) interconnected by a cylinder wall. The external housing includes a first fuel inlet (216), a second fuel inlet (217), a first exhaust outlet aperture (250) and a second exhaust outlet (260) disposed on the outside of the cylinder housing.

The engine cylinder further includes a hollow internal cage (270) having a first (upper) aperture (235) and a second (lower) aperture (245). The two apertures (235, 245) on the internal cage (270) are for receiving gaseous fuel mixture into the cavity of the cage which forms part of the combustion chamber and for expelling exhaust gases. It will be noted that the distance between the two apertures (235, 245) on the cage is substantially identical to the distance between the pair of fuel inlet and exhaust apertures on the external housing, that is, the distance between the pair of fuel inlet (216) and exhaust (250) or the second pair of fuel inlet (217) and exhaust (260).

Referring to FIG. 7*c*, the internal cage (270) includes a cavity with a pair of annular flanges (281, 282) disposed at the opposite distal ends. A correspondingly shaped piston member (220) is disposed within the internal cage (270) so that the piston member is slidable between the two annular flanges of the internal cage. These annular flanges are equivalent to the upstanding ends of the diaphram spacers (234, 244) of the embodiment of FIGS. 4*a* to 4*e*. An example construction of the internal cage is shown in FIG. 7*d* in which the internal cage includes a hollow cylindrical body having internal strew threads at its distal or axial ends. A pair of corresponding shaped cylindrical caps (283, 284) with a circular rim is provided for screwing into the cylindrical body. Bach of the caps has a closed end and an axially extending annular rim with external threads. When the threaded rims of the screw caps are fully received within the internal cage, the rim becomes the annular flange of the cylinder for limiting the range of movement of the piston member. The cage is substantially sealed except for the apertures (235, 245) for fuel inlet and burnt-gas outlet. In addition, the shape of the holes for receiving the bifurcated piston legs (224, 225) are preferably substantially identical.

In this embodiment, the diaphram valves are eliminated and the top and bottom of the internal cage is provided to correspond respectively to the function of the first and the second diaphram valves. In comparable terms to the earlier embodiments, it will be appreciated that the first fuel compartment (218) is formed between the top of the internal cage (270) and the first cylinder head (211) and the first combustion chamber (214) is formed between the top of the internal cage (270) and the piston member (220). Similarly, the second fuel compartment (219) is formed between the bottom of the internal cage and the second cylinder head (212) and the second combustion chamber is formed between the piston member and the bottom of the internal cage.

The sub-assembly of the piston member and the internal cage is placed inside the external housing and the operation of this cylinder will be explained below.

Referring FIGS. 8*a* to 8*e*, the operation of the engine cylinder including the piston member (220) disposed within a moveable internal cage (270) will be explained.

Figure 8A:
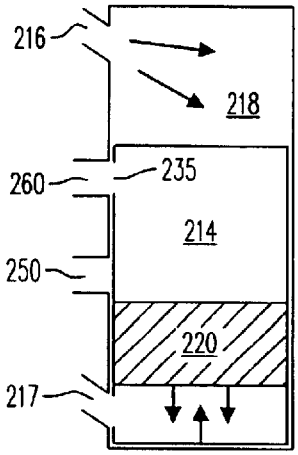
FIGS. 8*a* to 8*e* show a series of engine operation steps illustrating the operation of the engine of FIG. 7*c;*

Referring firstly to FIG. 8*a*, the bottom of the internal cage is resting against the second cylinder head (212) with the piston member (220) resting against the lower or second annular flange (282) of the cage so that the second combustion chamber (215) as defined by the general space between the piston member (220) and the bottom surface of the cage (270), is most compressed. It will be noted that, prior to the downward movement of the internal cage, the second fuel compartment (219), which is the space between the bottom of the internal cage and the second cylinder head has already been filled with a combustible fuel mixture. When the internal cage (270) moves downwards towards the second cylinder head (212), the fuel mixture will be transferred into the second combustion chamber (215) through the fuel transfer aperture. When the internal cage (270) reaches the second cylinder head (212) with the piston member (220) resting at the downward extreme position inside the internal cage, the second combustion chamber (215) is under the most compressed state and the gaseous fuel mixture within the second combustion chamber (215) will be timely ignited.

Figure 8B:
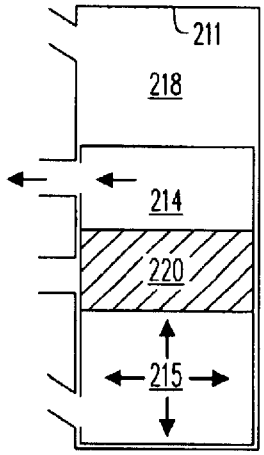

Referring to FIG. 8*b*, when the gaseous fuel mixture in the second combustion chamber (215) is ignited, the resulting combustion will push the piston member (220) towards the top of the internal cage and also towards the first cylinder head (211). When the piston member (220) gradually moves towards the top of the internal cage, the after-burnt resulting from the last combustion cycle in the first combustion chamber (214) will be expelled out of the cylinder through the top aperture (235) on the internal cage and the second exhaust aperture (260) on the external housing. Furthermore, when the piston member reaches the upper annular rim (281) of the internal cage, it will be stopped and the residual momentum will move the sub-assembly of the piston and the internal cage towards the first cylinder head.

Figure 8C:
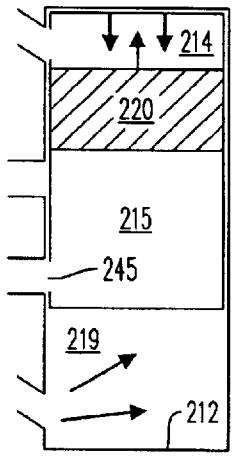

Referring to FIG. 8*c*, the top of the internal cage (270) is now at the first cylinder head (211). At this instant, the gaseous fuel mixture already present in the first fuel compartment (218), which is the space between the top of the internal cage and the first cylinder head, will have been transferred into the first combustion chamber (214) through the fuel by-pass path formed by alignment of the apertures on the internal cage as well as the main housing. At the same time, fresh gaseous mixture is also introduced into the second fuel compartment (219), it will also be noted that the first combustion chamber (214) at this instant is in the most compressed state.

Figure 8D:
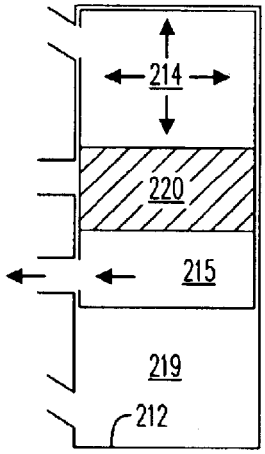

Referring to FIG. 8*d*, the gaseous fuel mixture present in the first combustion chamber (214) at its most compressed state has been ignited and the explosion resulting from the combustion causes the piston to move towards the bottom and of the internal cage. When the piston is moving towards the bottom end of the internal cage, the after-burnt resulting from the combustion of FIG. 8*b* will be expelled out of the cylinder through the alignment of the lower aperture (245) on the internal cage with the first exhaust aperture (250) on the external housing. When the piston reaches the lower annular rim (282) of the internal cage, the piston will be stopped with respect to the internal cage and the residual momentum will move the entire sub-assembly of the piston member (220) and the internal cage (270) towards the second cylinder head (212) as shown in FIG. 8*d*.

Figure 8E:
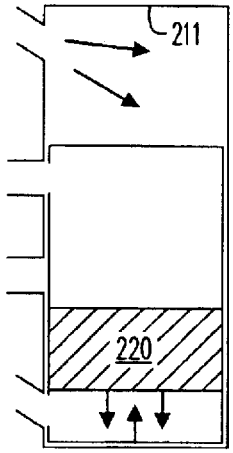

Referring to FIG. 8*e*, the sub-assembly of the piston member and the internal cage has reached the second cylinder head and the cylinder therefore resumes the state as shown in FIG. 8*a* and is ready to start another engine cycle. A four-stroke cycle of both the first combustion chamber and the second combustion chamber has therefore been completed.

Figure 12A:
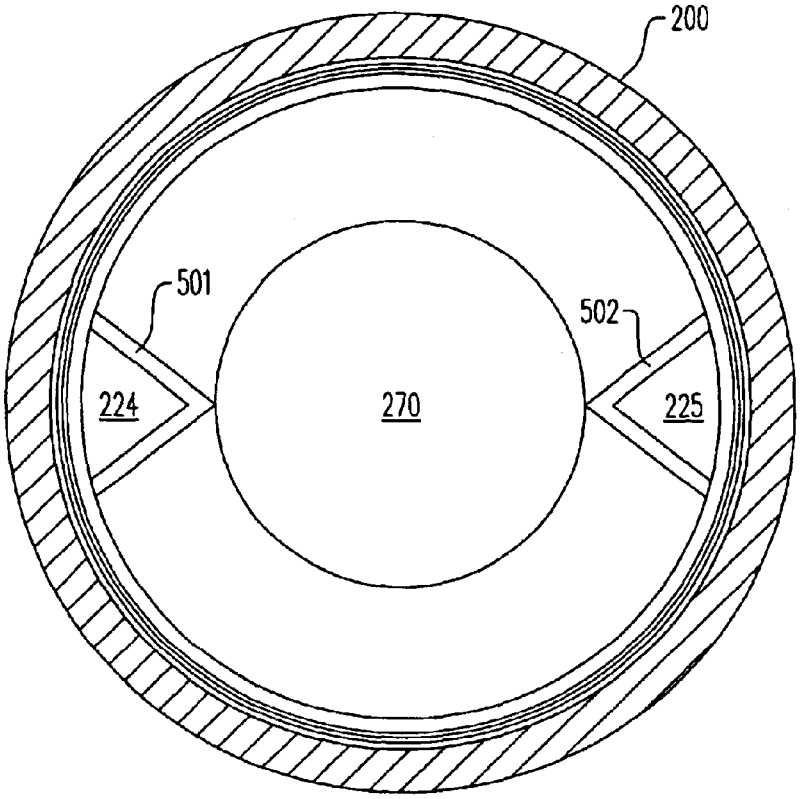
FIG. 12*a* shows the plane view of a cylinder with an internal cage showing the bifurcated legs and the associated apertures.
Figure 12B:
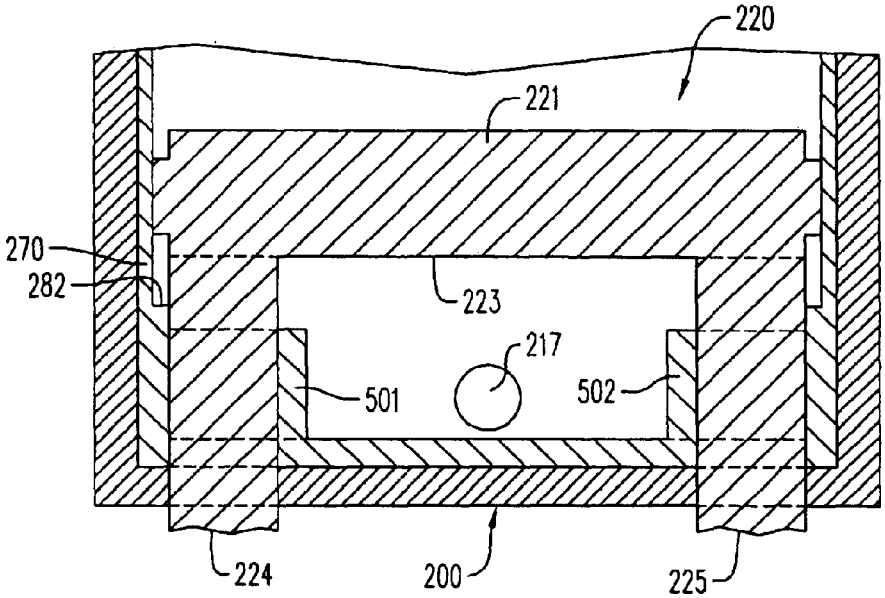
FIG. 12*b* shows a vertical cross-section of the cylinder and the internal cage of FIG. 12*a* with a piston member.

The plan view in FIG. 12*a* and the longitudinal cross-sectional view FIG. 12*b* illustrate in more detail the construction of the cylinder with an internal cage (270) and the bifurcated legs (224, 225) which protrude from the bottom end of the cage and for further protrusion from the second cylinder head. In addition, a pair of V-shaped fences (501, 502) is provided inside the cage for further or adequate protection of the bifurcated legs by mitigating the adverse impact of the explosion in the combustion chamber.

Examples of the external connection mechanisms for use with the cylinders of the present invention will be explained below.

Figure 9A:
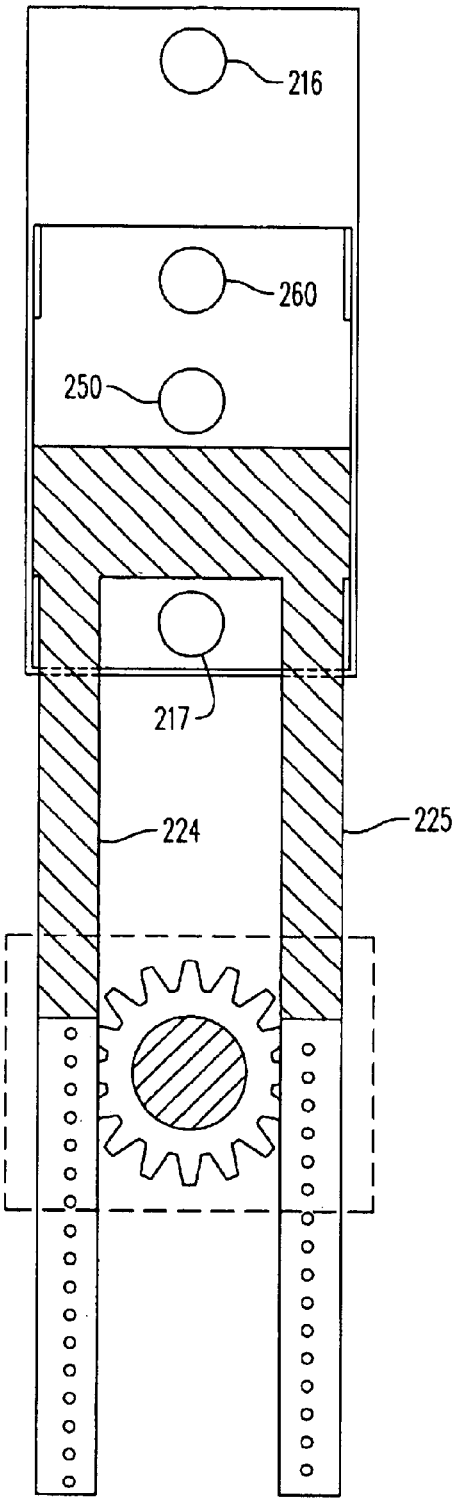
FIGS. 9*a* to 9*b* illustrate a preferred example of a connecting mechanism for connecting the piston to the outside for power output.
Figure 9B:
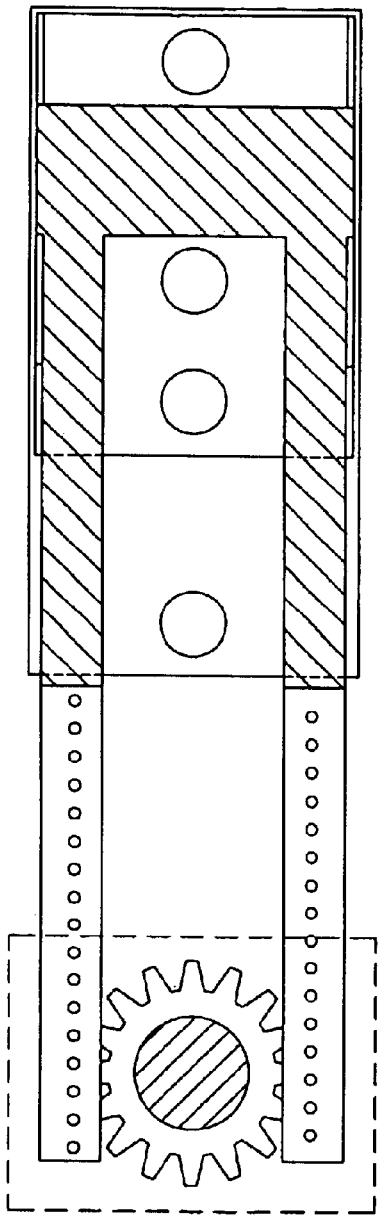

Firstly, referring to FIGS. 9*a* and 9*b*, there is shown a rotary teethed member in engagement with the bifurcated legs of the piston of the earlier embodiment. The construction of the cylinder is identical to that shown in FIGS. 7*a* and 7*b* with a first fuel inlet aperture (216), a first exhaust aperture (250), second fuel inlet (217) and second exhaust aperture (260). By providing corresponding teeth on the inside of the bifurcated legs of the piston member, the upward and downward movements of the piston can be transferred to the outside via the rotary wheel.

The relationship between the rotary wheel and the bifurcated legs of the piston member will be explained in further detail below.

FIG. 10 shows a longitudinal cross-section of the teeth arrangement on the two internal sides of the bifurcated legs of the piston members. A first rack (410) and the second rack (420) with ratchet teeth (430) are respectively formed on the internal left and right sides of the bifurcated legs. The ratchet teeth formed on the first (left) rack is arranged so that the teeth are in driving engagement relationship with the teeth (441) of the cogwheel (440) when the first rack moves downwards, and the ratchet teeth are escaped from such driving engagement when the first rack moves upwards. On the other hand, the ratchet teeth formed on the second rack is arranged in a manner which is generally opposite to that of the first rack. Thus, the ratchet teeth on the second rack are arranged so that the ratchet teeth are in driving engagement with the teeth on the cogwheel when the second rack moves upwards following explosion in the second combustion chamber and the teeth on the second rack can slide pass the cogwheel teeth in their downward movement of the second rack.

The teeth on the first rack is arranged so that when the piston member moves downward following explosion in the first combustion chamber, the teeth on the first rack will drive the teeth on the pinion so that the downward movement of the piston can be transmitted out of the cylinder through the axle of the cogwheel (440). When the piston member completes its downward movement, the second rack is moved upwards and the teeth on the second rack will drive the teeth on the cogwheel anti-clockwisely to move the piston upwards. The downward and upward movement of the piston are therefore completed by way of a single rotary pinion member without the need of a complicated transmission mechanism. Examples of appropriate ratchet teeth are shown in FIGS. 13*a* to 13*c*.

Figure 11A:
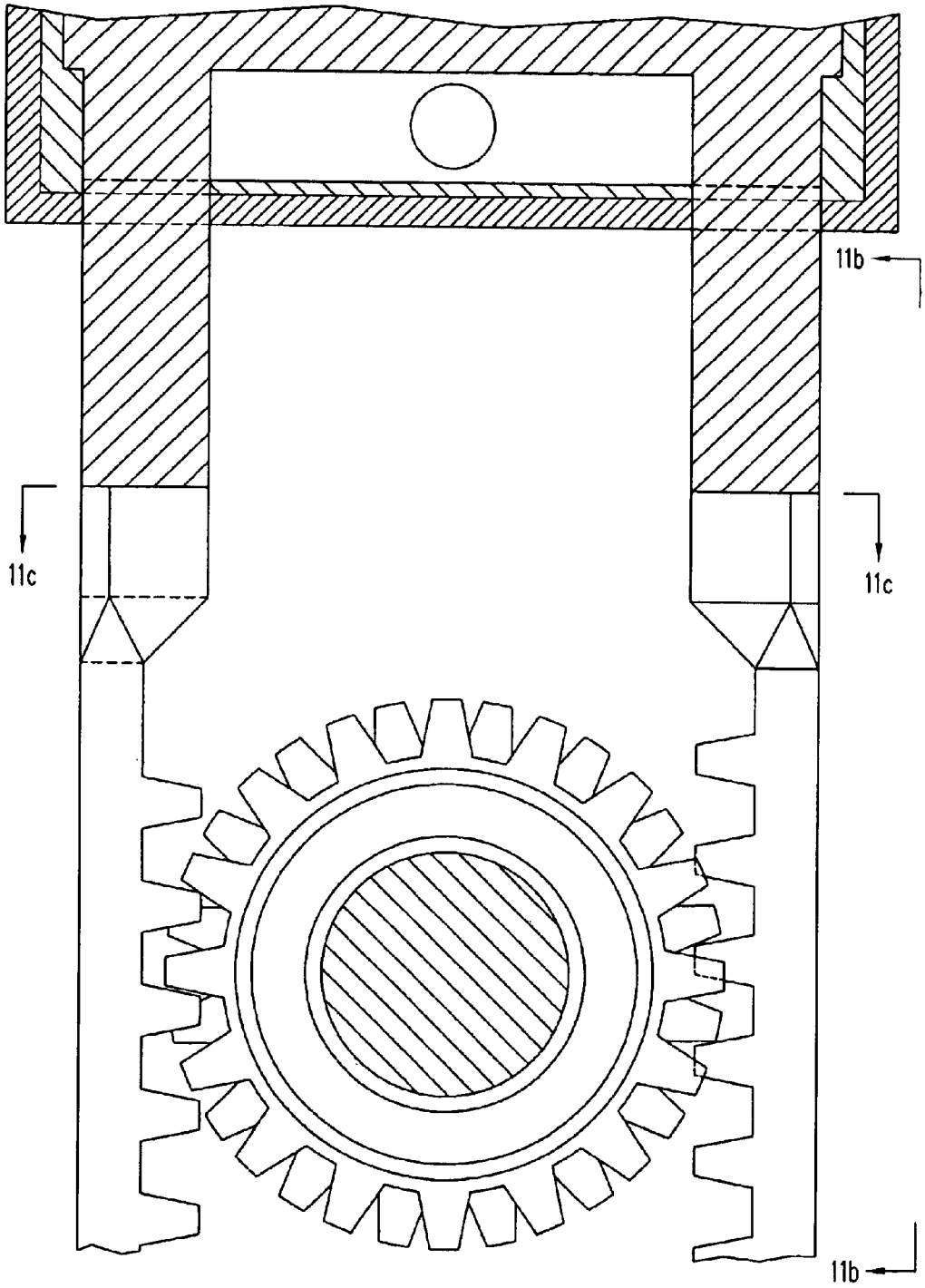
FIGS. 11*a* to 11*c* illustrate a second preferred example of a power transmission system for use with the present invention.
Figure 11B:
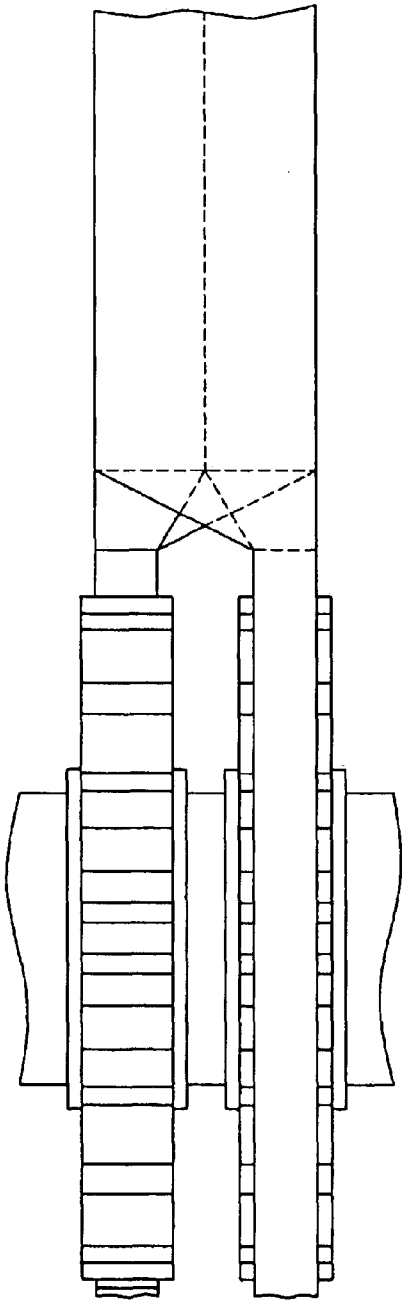
Figure 11C:
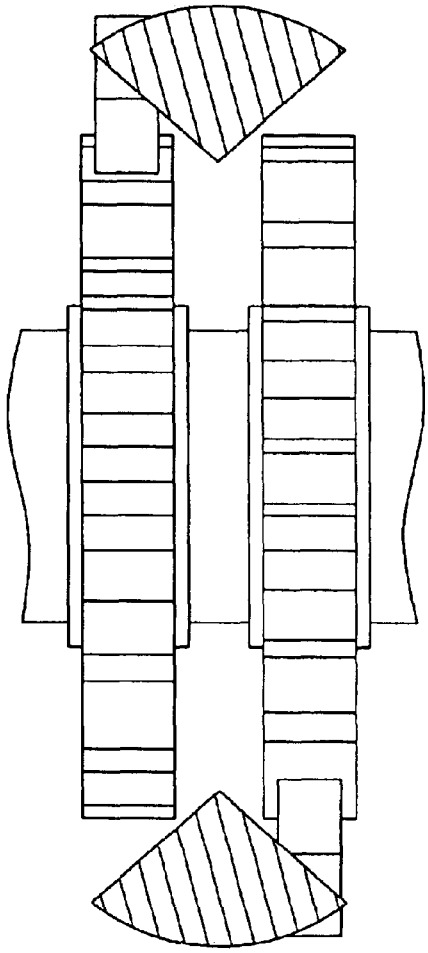

Another embodiment of the transmission arrangement is explained in FIG. 11, in this embodiment, the first and the second racks with solid teeth formed respectively on the bifurcated legs respectively engage with a first and a second ratchet cogwheel. The front ratchet cogwheel is arranged so that it will engage the left piston leg during the downward movement of the left leg but will be freely rotatable when the left piston leg moves upward. On the other hand, the rear ratchet cogwheel is engaged with the right piston leg in its upward movement so that only one of the cogwheels is engaged during the upward and downward piston movements. In general, these two ratchet cogwheels are independent and work in the opposite manner to the extent that engaging and freeing movements of the teeth on the bifurcated legs are concerned.

Figure 13A:
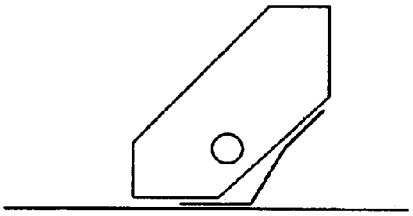
FIGS. 13*a* to 13*c* show a series of examples illustrating the principals of operation of the engaging members of FIG. 10.
Figure 13B:
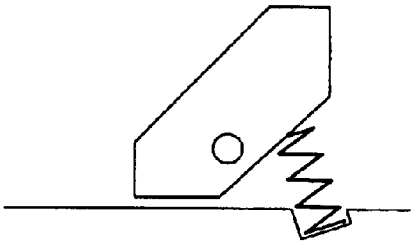
Figure 13C:
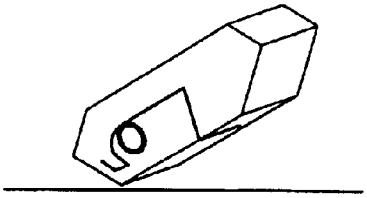

FIGS. 13*a* to 13*c* illustrate in more detail the tooth members which are suitable for use in the arrangement of FIG. 10.

Figure 14A:
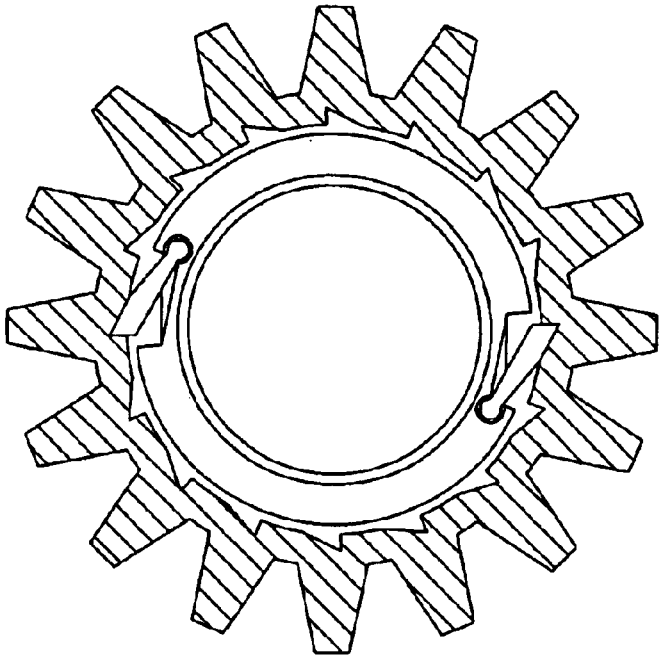
FIGS. 14*a* to 14*b* illustrate in more detail the operation of a unique direction ratchet arrangement for the cogwheel of FIG. 11.
Figure 14B:
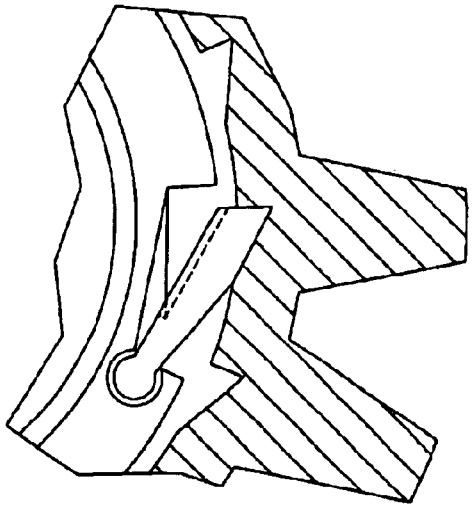

FIGS. 14*a* and 14*b* illustrate further examples of a ratchet cogwheel arrangement suitable for the present application in forming part of the transmission mechanism of FIG. 11.

Figure 15A:
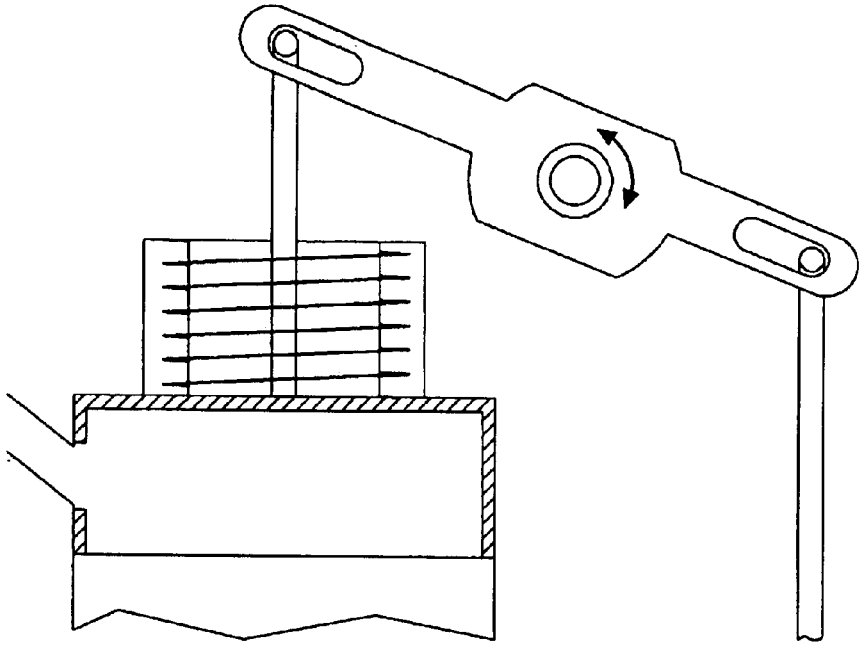
FIGS. 15*a* to 15*b* illustrate an engine arrangement for controlling the diaphram of the present invention.
Figure 15B:
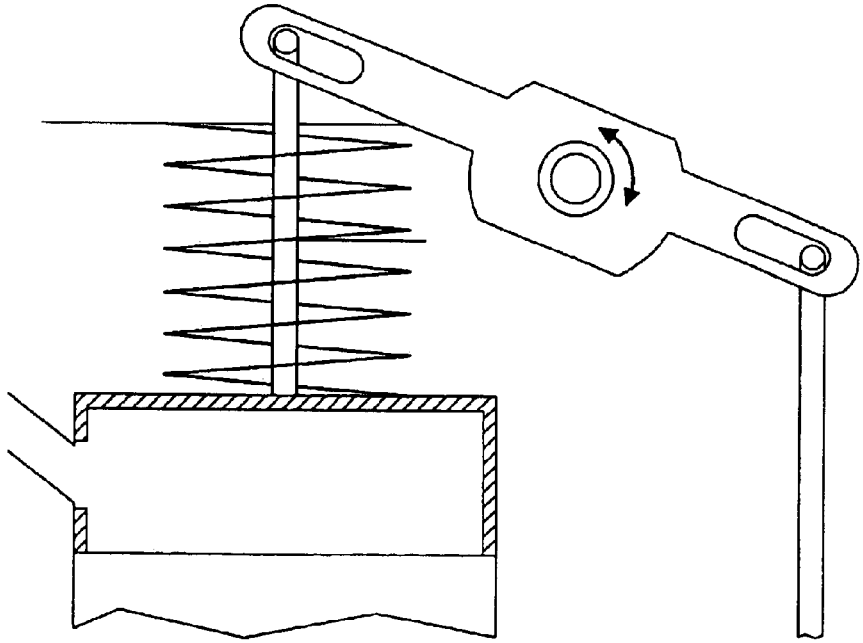

FIGS. 15*a* and 15*b* provide further illustration of a lever system for controlling the diaphram valve. In this configuration, the movement of the diaphram valve is controlled by a lever system with a pivotal point so that the diaphram valve can be externally controlled for durability and more independent of the aging problems of conventional spring means.

While the present invention has been explained by reference to the preferred embodiments described above, it will be appreciated that the embodiments are only examples provided to illustrate the present invention and are not meant to be restrictive on the scope and spirit of the present invention. This invention should be determined from the general principles and spirit of the invention as described above. In particular, variations or modifications which are obvious or trivial to persons skilled in the art, as well as improvements made on the basis of the present invention, should be considered as falling within the scope and boundary of the present invention. Furthermore, while the present invention has been explained by reference to a four-stroke engine, it should be appreciated that the invention can apply, whether with or without modification, to other internal combustion engine applications.

LIST OF NUMERALS

FIGS. 2 to 4

| | |
|---|---|
| 200 | Cylinder |
| 211 | first cylinder head |
| 212 | second cylinder head |
| 214 | first combustion chamber |
| 215 | second combustion chamber |
| 216 | first combustion chamber fuel inlet |
| 217 | second combustion chamber fuel inlet |
| 218 | first fuel compartment |
| 219 | second fuel compartment |
| 220 | piston member |
| 221 | piston head |
| 222 | first piston surface |
| 223 | second piston surface |
| 224 | first bifurcated leg |
| 225 | second bifurcated leg |
| 230 | first diaphram valve |
| 231 | first diaphram valve stem (connecting pin) |
| 232 | first diaphram valve spring |
| 233 | first diaphram valve transverse plate |
| 234 | first diaphram valve spacer |
| 235 | first diaphram valve spacer aperture |
| 240 | second diaphram valve |
| 241 | second diaphram valve stem (connecting pin) |
| 242 | second diaphram valve spring |
| 243 | second diaphram valve transversal plate |
| 244 | second diaphram valve spacer |
| 245 | second diaphram valve spacer aperture |
| 250 | exhaust outlet (first) |
| 260 | seconcd exhaust outlet |
| 270 | Internal cage |
| 281 | first annular flange on internal cage |
| 282 | second annular flange on internal cage |
| 283 | top cap of cage |
| 284 | bottom cap of cage |
| 331 | central post to first cylinder head |
| 332 | helical spring for FIG. 5a |
| 333 | Annular groove surrounding 331 |
| 341 | central post to second cylinder head |
| 342 | helical spring for FIG. 5b |
| 343 | Annular groove surrounding 341 |
| 410 | first rack |
| 420 | second rack |
| 430 | ratchet teeth |
| 440 | Cogwheel |
| 441 | Cogwheel teeth |
| 501 | first fence member |
| 502 | second fence member |

What is claimed is:

1. An internal combustion engine including at least one engine cylinder, said cylinder including a cylinder cavity with first and second cylinder heads which are interconnected by a cylinder wall, a piston member which is slidably moveable within said cylinder cavity between a first and a second extreme positions which are intermediate said first and second cylinder heads, such that said piston member partitions said cavity into a first combustion chamber and a second combustion chamber which alternatively combust when said engine is in normal operation, said piston member being connected with a power transmission member extending from said piston member to outside said cylinder cavity, and a slidable diaphram member disposed in each said combustion chamber and partitioning said combustion chamber into a first compartment with one end being a cylinder head and a second compartment with one end being said piston, said first and second compartments being generally not mutually communicable except at a specific position of said diaphragm member at which position combustible gas in said first compartment will be transferred to said second compartment during normal engine operations.

2. An engine of claim 1, said diaphram member including a spacer separating a cylinder head and the corresponding piston surface of a combustion chamber, thereby defining the minimum volume of said combustion chamber, wherein said power transmission member extends from inside said cylinder cavity to outside said cylinder cavity.

3. An engine according to claim 1, wherein, during normal engine operations, combustion occurs in said second compartment of one combustion chamber in the enclosed space between said diaphram member and said piston, such that, during combustion, said piston is driven away from said diaphram member and pushed towards the other chamber to compress said other chamber.

4. An engine according to claim 3, further including means to drive each diaphram member towards said piston to remove exhaust from said cylinder subsequent to each combustion involving the chamber containing said diaphram member.

5. An engine according to claim 4, wherein combustible gaseous fuel is introduced into said first compartment of a combustion chamber at the time when exhaust is being removed from said second compartment of said chamber.

6. An engine according to claim 5, wherein combustible fuel is introduced into said first compartment through a valve aperture, said aperture forming a communication path between said first and second compartments when aligned with a specific part on said diaphram member, thereby allowing compressed gaseous fuel to be transferred from said first compartment into the adjacent second compartment.

7. An engine according to claim 3, wherein combustion in one combustion chamber forces said piston and the diaphram member of another chamber to move towards the cylinder head of that other chamber to compress the gaseous fuel in said first compartment of that other chamber during normal engine operation.

8. An engine according to claim 1, wherein said power transmission member extends from inside said cylinder cavity to outside said cylinder cavity, said cylinder being characterised in that when a combustion chamber is maximally compressed, the other combustion chamber is fully relaxed and vice versa, the length of the portion of said power transmission member outside said cylinder cavity being determined by the instantaneous position of said piston member.

9. An internal combustion engine including at least one engine cylinder, said cylinder including a cylinder cavity with first and second cylinder heads which are interconnected by a cylinder wall, said cylinder further including a piston member which is slidably moveable within said cylinder cavity between first and second extreme positions which are intermediate said first and second cylinder heads, such that said piston member partitions said cavity into a first combustion chamber and a second combustion chamber which alternatively combust when said engine is in normal operation, said piston member being connected with a power transmission member extending from said piston member to outside said cylinder cavity, and a slidable diaphram member disposed in each said combustion chamber, said diaphram member including a spacer separating a cylinder head and the corresponding piston surface of a combustion chamber, thereby defining the minimum volume of said combustion chamber, said diaphram member including a base and a wall surrounding said base, said wall axially extending away from said base and said cylinder head adjacent said base such that the axial extension of said wall defines the minimum axial clearance of said combustion chamber containing said diaphram member.

10. An engine according to claim 9, wherein an aperture is formed on said wall surrounding said base, such that said aperture provides a communication path between the two sides of said diaphram member within said chamber when said diaphram member is moved to a specific, predetermined position.

11. An engine according to claim 10, wherein said predetermined position corresponds to the position when said volume of said chamber is at a minimum.

12. An internal combustion engine including at least one engine cylinder, said cylinder including a cylinder cavity with first and second cylinder heads which are interconnected by a cylinder wall, said cylinder further including a piston member which is slidably moveable within said cylinder cavity between first and second extreme positions which are intermediate said first and second cylinder heads, such that said piston member partitions said cavity into a first combustion chamber and a second combustion chamber which alternatively combust when said engine is in normal operation, said piston member including a bifurcated pair of legs protruding out of said cylinder, said bifurcated legs being connected with a rotary power transmission member which converts the translational movements of said bifurcated legs into rotary movements of said rotary member.

13. An engine according to claim 12, wherein each said bifurcated leg includes ratchet teeth which are engageable with teeth on said rotary member, said teeth on said bifurcated legs being arranged so that said teeth on said bifurcated legs are in driving engagement with the teeth on said rotary member when said bifurcated legs move in a first direction and said teeth on said bifurcated legs and said rotary member are not in driving engagement when moving in a direction opposite to said first direction, said direction of movements of said bifurcated legs for driving engagement with the teeth on said rotary member being opposite for teeth disposed on the two legs forming the bifurcated legs.

14. An internal combustion engine including at least one engine cylinder, said cylinder including a cylinder cavity with first and second cylinder heads which are interconnected by a cylinder wall, said cylinder further including a piston member which is slidably moveable within said cylinder cavity between first and second extreme positions which are intermediate said first and second cylinder heads, such that said piston member partitions said cavity into a first combustion chamber and a second combustion chamber which alternatively combust when said engine is in normal operation, said piston member including a bifurcated pair of legs protruding out of said cylinder, said bifurcated legs being connected with a first and second rotary power transmission members which convert the translational movements of said bifurcated legs into rotary movements of said rotary members, said first and second rotary members including ratchet wheels movable in opposite angular orientations.

15. An internal combustion engine including at least an engine cylinder, said engine cylinder including a hollow cylinder room enclosed by a cylinder wall and a first and a second cylinder heads at the ends of said cylinder room, said engine cylinder further including a piston having a first and a second piston surfaces, said piston being disposed within said cylinder room and partitioning said cylinder room into a first and a second combustion chambers, wherein said first combustion chamber is formed by co-operation of said first piston surface and said first cylinder head and said second combustion chamber is formed by co-operation of said second piston surface and said second cylinder head, said piston being movable between a first and a second piston positions between said cylinder heads and being connected with a power transmission link which extends from one of said piston surfaces towards the corresponding opposing cylinder head and exits from said cylinder room at said corresponding opposing cylinder head to extend outside said cylinder room, said first and second piston positions corresponding respectively to said first and second combustion chambers at their minimum chamber volumes, such that, during engine operations, a complete cycle of reciprocating movements of said piston from one starting position back to that starting position corresponds to a complete engine combustion cycle in both said first and second combustion chambers.

16. An internal combustion engine of claim 15, wherein said power transmission link includes a bifurcated pair of elongated members which extend along the direction of motion of said piston.

* * * * *